US007222868B2

(12) United States Patent
Norman et al.

(10) Patent No.: US 7,222,868 B2
(45) Date of Patent: May 29, 2007

(54) SEATING UNIT WITH WHEELCHAIR BASE

(75) Inventors: Christopher J. Norman, Byron Center, MI (US); Kurt R. Heidmann, Grand Rapids, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 11/142,133

(22) Filed: Jun. 1, 2005

(65) Prior Publication Data

US 2006/0273541 A1 Dec. 7, 2006

(51) Int. Cl.
*A61G 5/00* (2006.01)

(52) U.S. Cl. ..... 280/250.1; 297/118; 297/344.12

(58) Field of Classification Search ..... 280/250.1; 297/118, 344.12
See application file for complete search history.

(56) References Cited

U.S. PATENT DOCUMENTS

| | | | | |
|---|---|---|---|---|
| 2,609,862 | A | 9/1952 | Pratt | |
| 3,216,738 | A * | 11/1965 | Bockus | 280/30 |
| 3,945,449 | A | 3/1976 | Ostrow | |
| 3,950,026 | A | 4/1976 | Van Seenus | |
| 4,274,503 | A | 6/1981 | Mackintosh | |
| 4,362,311 | A | 12/1982 | Bergman | |
| 4,729,447 | A | 3/1988 | Morse | |
| 4,776,416 | A | 10/1988 | Morse | |
| 4,967,864 | A | 11/1990 | Boyer | |
| D326,437 | S | 5/1992 | Kuhl | |
| D327,041 | S | 6/1992 | Kuhl | |
| 5,123,495 | A | 6/1992 | Littlejohn et al. | |
| 5,137,102 | A | 8/1992 | Housten, Sr. et al. | |
| 5,156,226 | A | 10/1992 | Boyer | |
| 5,179,745 | A | 1/1993 | Hebert et al. | |
| 5,183,133 | A | 2/1993 | Roy | |
| 5,466,111 | A | 11/1995 | Meyer | |
| 5,507,513 | A | 4/1996 | Peters et al. | |
| 5,782,536 | A | 7/1998 | Heidmann | |
| 5,971,482 | A | 10/1999 | Goertzen et al. | |
| 6,068,280 | A | 5/2000 | Torres | |

(Continued)

FOREIGN PATENT DOCUMENTS

DE 19614172 A1 * 10/1997

(Continued)

OTHER PUBLICATIONS

Advances Brochure, Issue 44, Year: 2004, 11 pages.

*Primary Examiner*—Kevin Hurley
(74) *Attorney, Agent, or Firm*—Price, Heneveld, Cooper, DeWitt & Litton LLP

(57) ABSTRACT

A seating unit includes a seat, a back, and a support structure supporting the seat and the back. A wheelchair base frame includes a beam extending transversely across the wheelchair base frame. An adjustable extendable column extends between the beam and the support structure for adjustably supporting the seating unit on the wheelchair base frame. The support structure and/or the transverse beam can be constructed to receive the same structure as is provided on a standard task chair. By this arrangement, a plurality of similar chairs can be ordered, some having standard bases and others having a wheelchair base. Concurrently, the seating unit with the wheelchair base can include substantially all options and styling offered in the standard task chair.

14 Claims, 4 Drawing Sheets

U.S. PATENT DOCUMENTS

| | | | | |
|---|---|---|---|---|
| 6,179,076 | B1 | 1/2001 | Fernie | |
| 6,220,382 | B1 | 4/2001 | Kramer, Jr. et al. | |
| 6,220,620 | B1 | 4/2001 | Harroun | |
| 6,276,704 | B1 | 8/2001 | Suiter | |
| 6,290,011 | B1 | 9/2001 | Langaker et al. | |
| 6,467,785 | B2 | 10/2002 | Toppses | |
| 6,467,788 | B1 | 10/2002 | Li et al. | |
| 6,494,474 | B1 | 12/2002 | Kramer, Jr. | |
| 6,536,841 | B1 | 3/2003 | Pearce et al. | |
| 6,684,969 | B1 | 2/2004 | Flowers | |
| 6,687,933 | B2 | 2/2004 | Habboub et al. | |
| 6,702,049 | B2 | 3/2004 | Cheng | |
| 6,814,411 | B1 | 11/2004 | Lin | |
| 6,869,142 | B2 | 3/2005 | Heidmann et al. | |
| 2003/0209931 | A1* | 11/2003 | Glaser | 297/344.12 |
| 2004/0051279 | A1* | 3/2004 | Grant et al. | 280/638 |
| 2004/0051358 | A1 | 3/2004 | Bodnar | |
| 2005/0087957 | A1* | 4/2005 | Bennett et al. | 280/647 |
| 2005/0151360 | A1* | 7/2005 | Bertrand et al. | 280/755 |

FOREIGN PATENT DOCUMENTS

| | | | |
|---|---|---|---|
| EP | 945114 | A1 * | 9/1999 |
| WO | WO 9302648 | A1 * | 2/1993 |

* cited by examiner

SEATING UNIT WITH WHEELCHAIR BASE

BACKGROUND

The present invention relates to wheelchairs, and more particularly relates to a seating unit having wheelchair function in terms of large rolling wheels, but constructed with a more standardized task chair seating structure.

Wheelchairs are designed with the intention of meeting the needs of handicapped individuals. However, those needs vary widely across a wide spectrum of needs and user abilities. In fact, many wheelchair-bound individuals are relatively high functioning. Consistent with that, they want a wheelchair that is light-weight and able to be manually powered, that is adjustable, and is more consistent with (i.e. adaptable for doing tasks while seated in) traditional task chairs. In particular, many individuals want a wheelchair that is more stylized and with more user-controlled options, and that fits in more aesthetically with other chairs in their office complex. Accordingly, there is a need to give wheelchair bound individuals the opportunity to utilize highly designed and styled chairs, including chairs having the appearance of "standard" chairs that can be ordered, so that wheelchair-bound individuals do not feel like they are socially different. Also, there is a need to facilitate ordering of chairs, such as when a new office complex is being set up.

Thus, a system having the aforementioned advantages and solving the aforementioned problems is desired.

SUMMARY OF THE PRESENT INVENTION

In one aspect of the present invention, a seating unit includes a seating assembly including a support structure, a wheelchair base including a horizontal beam, and an adjustable support extending between the beam and the support structure for adjustably supporting the seating assembly on the wheelchair base frame.

In another aspect of the present invention, a seating unit includes a seat and a back, a wheelchair base including a pair of manually-operable wheels and including a frame located between the wheels, and a vertically-adjustable support supporting the seat and the back on the frame.

In another aspect of the present invention, a seating unit includes a seating component, a wheelchair base including manually-rotatable rear wheels defining an axis of rotation and a frame member defining a centered support location that is below and forward of the axis of rotation, and a vertical member supporting the seating unit on the frame member at the support location between the rear wheels.

In still another aspect of the present invention, a method of selling seating includes steps of providing seating assemblies each having at least a seat, providing a plurality of bases adapted to support individual ones of the seating assemblies including at least one standard base and at least one wheelchair base, and ordering a plurality of seating units including seating assemblies assembled onto standard bases and at least one seating assembly assembled onto the wheelchair base.

These and other aspects, objects, and features of the present invention will be understood and appreciated by those skilled in the art upon studying the following specification, claims, and appended drawings.

BRIEF DESCRIPTION OF DRAWINGS

FIG. 5 is similar to FIG. 4, but with the rear wheel broken away to better show the wheelchair base frame.

DETAILED DESCRIPTION OF PREFERRED EMBODIMENTS

Figure 1:
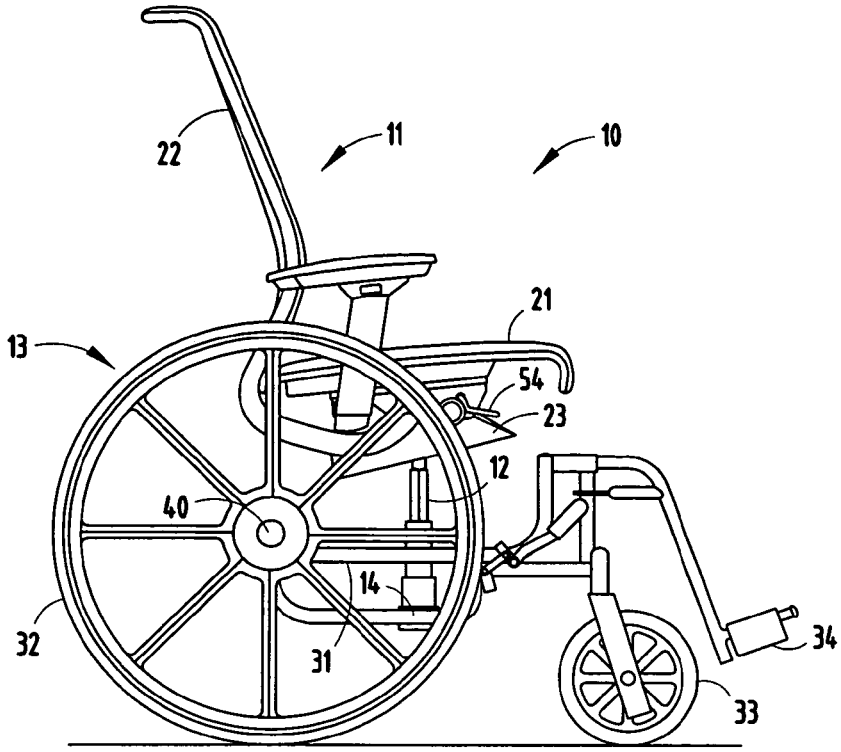
FIGS. 1–3 are side, front, and top views of a wheelchair embodying the present invention.
Figure 2:
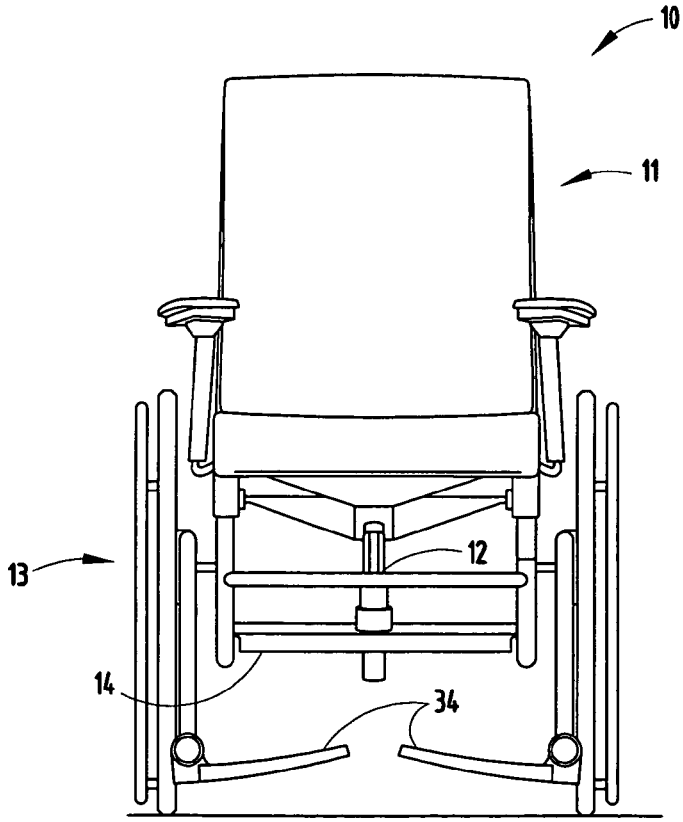

A seating unit 10 (FIG. 1) is illustrated that includes a seating assembly 11 supported by an adjustable column 12 on a wheelchair base 13. The column 12 is an extendable column that incorporates a pneumatic/gas spring for assisted height adjustment of the seating assembly 11, such as is often found in task chairs. The wheelchair base 13 is modified to allow a relatively standardized seating assembly 11 to be positioned on a transverse beam 14 in the wheelchair base 13. By this arrangement, the area around the column 12 is relatively open and unobstructed (including the area inside the rear wheels 32 and beside the seat 21), allowing the use of seating units 11 having underseat controls and multiple seat and back adjustments, which items are commonly found in modern task chairs but rarely found in wheelchairs. Thus, a wide variety of different seating units 11 can be used on the wheelchair base 13 without substantial re-design and without the need for substantial new tooling. This novel arrangement allows construction of seating units 10 that take full advantage of existing seating unit constructions, including using their aesthetics and functionality.

The illustrated seating assembly 11 includes a seat 21, a back 22, and an underseat support structure 23 (sometimes called a "chair control") supporting the seat 21 and the back 22 for synchrotilt motion. A seating unit similar to that shown is found in Heidmann U.S. Pat. No. 6,869,142, and also in Published Application No. U.S. 2004/0051358 A1, the entire contents of which are incorporated herein in their entirety for the purpose of teaching their structure and function. Even though a particular seating assembly 11 is illustrated, it is contemplated that the support structure and corresponding seating unit can be any of a variety of different such structures known in the art, such as a control that holds the back and seat fixed, or a control that holds the seat fixed but permits the back to recline, or a control that permits the back and seat to recline as a unit, or a synchrotilt chair control providing simultaneous recline of the back and seat at different angular rates of motion.

Figure 3:
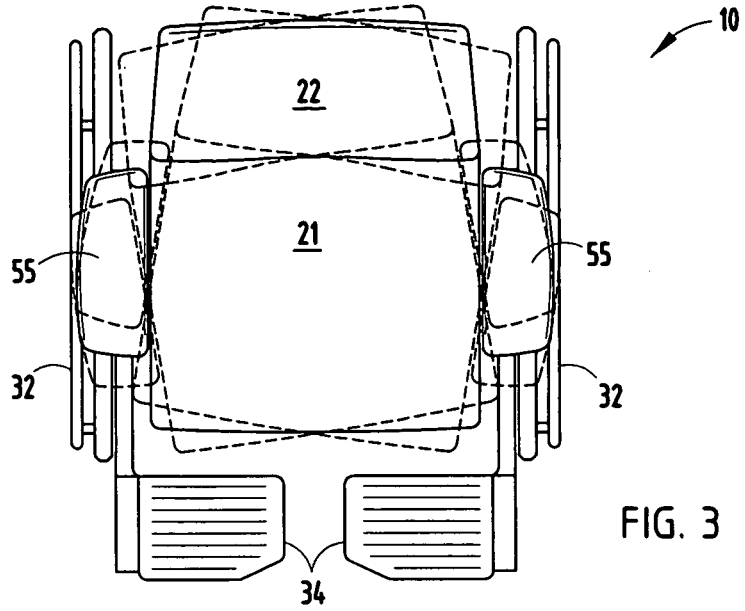
Figure 7:
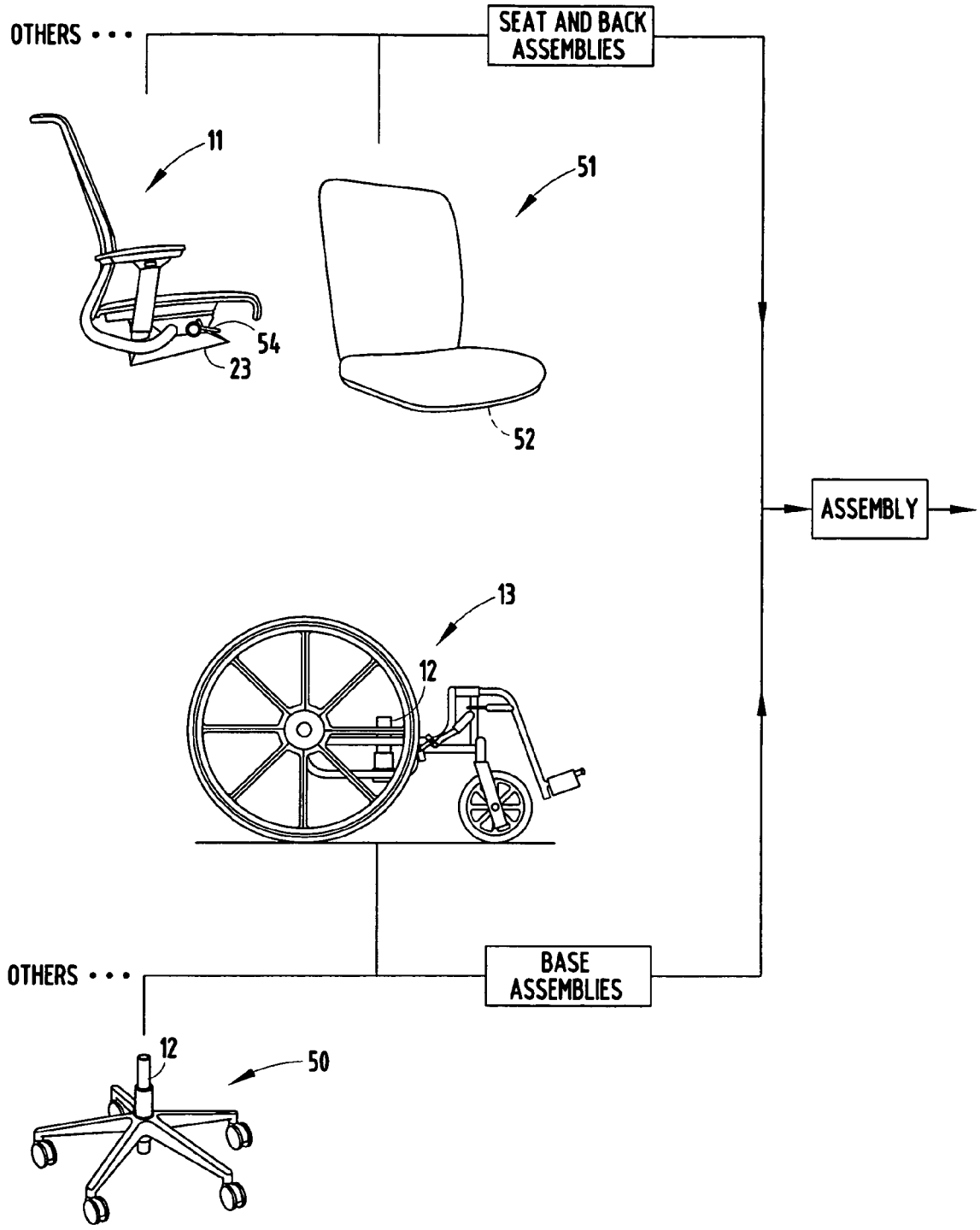
FIG. 7 is a flow chart showing a method of assembly.

The illustrated column 12 is non-rotatable, such that the seating assembly 11 does not rotate back and forth as a seat user manually operates the wheels 32 for movement. Non-rotation can be important so that the seated user has good leverage for pulling or pushing on the wheels 32 to move the wheelchair. However, it is contemplated that the transverse beam 14 can include a center connection replicating the hub of a more traditional chair base (see base 50, FIG. 7), such as is often found at the center of a task chair having a base with radially-extending legs. Thus, a more traditional rotation-permitting column 12 could be used from a pre-existing pre-designed (task chair) seating unit or base (see base 50, FIG. 7). In such circumstance, the seating assembly 11 and/or column 12 will rotate on the beam 14 unless otherwise restricted. (See dashed lines in FIG. 3.) Where seat rotation is allowed, it may be desirable to provide an anti-rotation lock for selectively preventing rotation of the seating unit 11 and the column 12 in order to prevent or limit angular rotation of the seating assembly 11 on the base (13). It is contemplated that the anti-rotation lock could engage parts of the column 12 itself, or could be a second extendable post extending between the beam 14 and the seating assembly 11. Alternatively, the anti-rotation lock could be a T-shaped device pivotally attached to the armrests of the seating assembly 11, where the device is selectively pivotable outwardly and includes front and rear rollers engaging the inside of the wheels 32 at front and rear spaced-apart locations thus stabilizing the seating assembly 11 on the base 13 for non-rotation in a horizontal plane.

Figure 5:
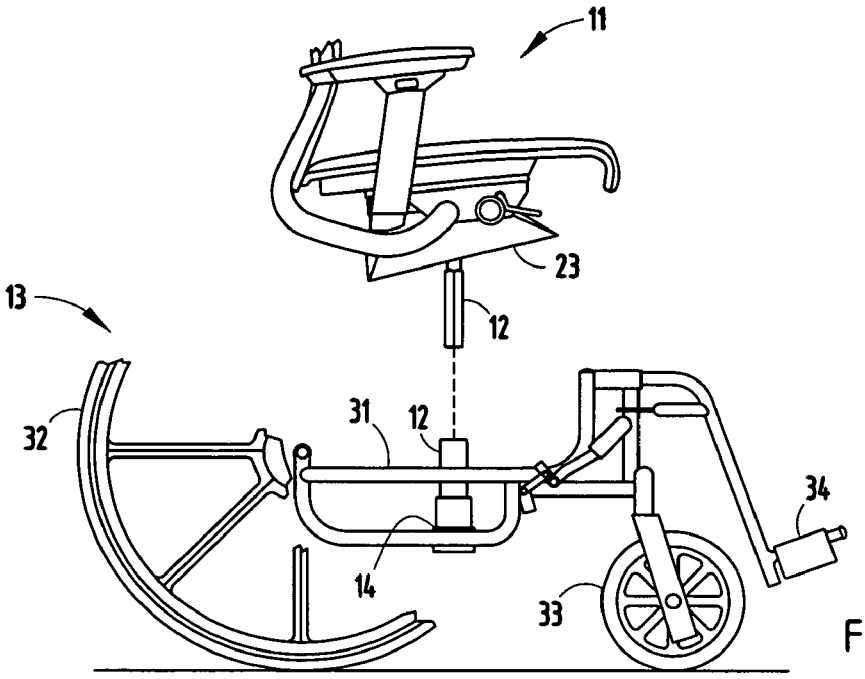
Figure 6:
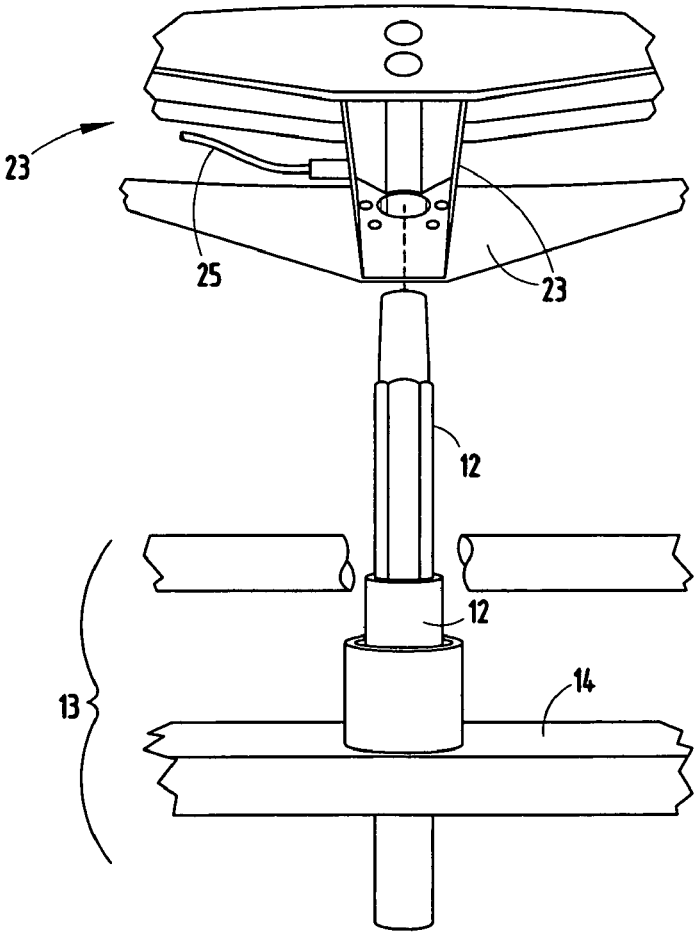
FIG. 6 is an enlarged fragmentary front view showing the connection of the wheelchair base frame to the vertically extendable column and to a bottom of the underseat control of the seating unit.

The present wheelchair base 13 includes a wheelchair frame 30 (FIG. 5) having opposing side frame sections 31, each supporting a large diameter rear wheel 32 and a smaller front "steerable" wheel 33 located under leg/foot supports 34. The transverse beam 14 extends transversely across the wheelchair base frame 30 between the side frame sections 31, rigidly connecting them at a predetermined spaced-apart distance. The adjustable extendable column 12 extends vertically between the beam 14 and the support structure 23. A height-adjustment control 25 on the support structure 23 includes a portion shaped to selectively engage the release button on a top of the extendable column 12, for releasing the pneumatic spring therein. The wheels 32 are spaced apart a sufficient distance and/or a width of the seating assembly 11 is sufficiently narrow such that the height-adjustment control 25 can be manipulated beside the seat 21 (inboard of the wheel 32) to release the gas spring for assisting with height adjustment of the seating assembly 11 on the wheelchair base 13. Also, the seating assembly 11 can be supported for limited angular rotation between the wheels 32, allowing the seated user to rotate his seated position without having to change an entire rotation of the seating unit 10. Notably, armrests 55 are supported under the seat 21 on control housing 23, and extend upwardly beside the seat 21 inside of the wheels 32. Due to their location near the axis of rotation 40 of the wheel 32, supports for the armrests 55 do not interferingly engage the wheels 32 during rotation of the seating assembly 11.

The illustrated column 12 is non-rotatable, but can be made to permit the seating assembly 11 to rotate a limited amount on the transverse beam 14. This rotation may be desirable, since it allows a seated user to re-orient themselves to face a new direction relative to a work surface (or relative to a person for discussion purposes) without having to grasp and motivate one or both of the wheels 32. It may be desirable to limit the rotation of the seating assembly 11 in order to prevent the seating assembly 11 from striking the wheels 32. Stops can be provided on the inside of the side frame section 31 and/or can be provided on the column 12 and/or can be provided on the underseat control 23. Alternatively, the wheels 32 can act as a natural stop. In the illustrated apparatus 10, the seating assembly 11 clears the rear wheels 32 by about 2 to 3 inches on each side. Therefore, it could be made to rotate from a centered position several degrees in either direction. This distance would also provide clearance for armrest supports which extend from the underseat control 23 outward and then upward adjacent sides of the seat 21. Where desired, detents and/or friction can be provided to limit rotation of the seating assembly 11 on the column 12 (and limit rotation of the column 12 on the beam 14), so that the seating assembly 11 stays at a desired selected orientation relative to the base 13. The detent and/or friction-generating device can be at any one of the interfacing connections of the base 13 to the column 12, or of the column 12 to the control 23, or can be a separate member extending from the wheelchair frame to engage and fix the seat.

Figure 4:
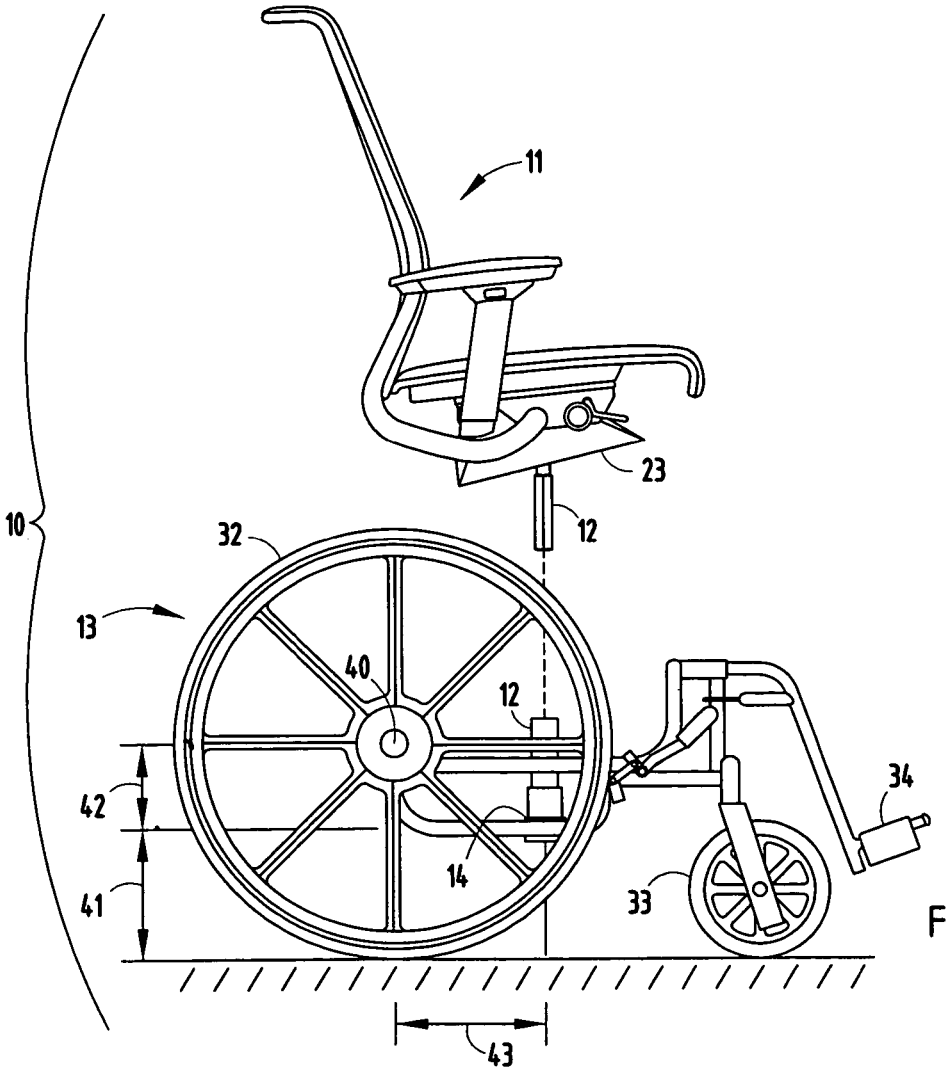
FIGS. 4–5 are exploded side views similar to FIG. 1, but FIG. 4 shows the seating unit exploded away from the wheelchair base.

The beam 14 on the wheelchair base 13 is located at a position below and forward of the axis of rotation 40 (FIG. 4) for the rear wheels 32 for stability of the overall apparatus 10 when a user is seated therein. The beam 14 is located at a low enough position so that, when the seating assembly 11 is positioned on a column 12, its seat 21 is able to fit under a standard height desk or work surface. In the illustrated arrangement, the transverse beam 14 is positioned about 5.75 inches above a floor surface (dimension 41), which is about 6.0 inches below the axis 40 (dimension 42), and at about 8.0 inches forward of the axis 40 (dimension 43). A top of the column 12 is 1–2 inches above the axle 40, depending on adjusted seat height.

The illustrated beam 14 is tubular and extends horizontally a sufficient distance to space the rear wheels 32 about 1 to 2 inches outboard of the edges of the seat. The beam 14 has a square cross-section, but it is contemplated that it can be different sizes and shapes as needed for functional requirements of the design. The beam 14 has a tapered socket formed therein for receiving a tapered lower end of the column 12, such that it is constructed to matably receive a lower end of the column 12 provided on the standard task chair (i.e., seating assembly 11) that can be ordered. This greatly facilitates selling/ordering and assembly. Specifically, by this arrangement, a plurality of "similar" seating units can be ordered by a new customer through a furniture dealer, some having standard bases (i.e., "standard" task chairs) (see exemplary base 50, FIG. 7) and others having a wheelchair base (e.g. wheelchair base 13). Each of the seating units can have any of the desired seat adjustment controls. (See exemplary basic seating assembly 51 with underseat control/support structure 52 with minimal underseat controls, and also note seating unit 11 which has an underseat control/support structure 23 with adjustable control handles 54 for operating/adjusting different chair functions such as spring tension for adjustable back support upon recline, selectable back stop and/or back lock functions affecting back recline, adjustable lumbar support, adjustable armrests, etc.) In particular, the seating apparatus with wheelchair base can include any one or all of the control options and styling (and armrests or headrests) offered in the "standard" task chair lines, since there is some clearance provided between the seating assembly and the wheelchair rear wheels. Assembly of the seating apparatus including the wheelchair base 13 includes taking the seating assembly 11 with column 12 and telescopingly engaging the components together and into the socket in the beam 14 of the base 13.

It is noted that the seating units disclosed in the following patents and publications are exemplary of seating units that could be used on the present wheelchair base: Heidmann U.S. Pat. No. 5,782,536; Heidmann U.S. Pat. No. 5,975,634; Pearce U.S. Pat. No. 6,636,841; Heidmann U.S. Pat. No. 6,869,142; and Published Application No. U.S. 2004/0051358 A1 (Ser. No. 10/455,503).

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. A seating unit comprising:

a seating assembly including a seat, a back, and a chair control operably supporting the seat and back for synchronized movement, the chair control having a downwardly facing support structure;

a wheelchair base including a horizontal beam; and an adjustable support extending between the beam and the support structure for adjustably supporting the seating assembly on the wheelchair base frame, wherein the wheelchair base includes opposing side subframes connected by the beam, the beam extending laterally therebetween.

2. The seating unit defined in claim 1, wherein the seating assembly includes a seat, wherein the wheelchair base includes a pair of wheels with rims extending above the seat, and wherein a side of the seat and an inside of the wheels defines a space therebetween sufficient to permit access to a control under the seating assembly.

3. The seating unit defined in claim 1, wherein the seating assembly includes a seat that is both rotatable to different angular positions relative to the base and also lockable relative to the base to prevent undesired rotation.

4. The seating unit defined in claim 1, wherein the adjustable support is connected to the beam at a location that is adapted to be near a center of gravity of the seating assembly when a user is seated therein.

5. The seating unit defined in claim 1, including armrests supported by one of the seating assembly, the support and the beam.

6. The seating unit defined in claim 1, wherein the seating unit includes a control housing and a controllable component thereon, and including a handle operably connected to the controllable component for operating the component.

7. A seating unit comprising:

a seating assembly including a seat, a back, and a chair control operably supporting the seat and back for synchronized movement, the chair control having a downwardly facing support structure;

a wheelchair base including a horizontal beam; and an adjustable support extending between the beam and the support structure for adjustably supporting the seating assembly on the wheelchair base frame, wherein the wheelchair base includes rear wheels, and wherein the beam is located below an axis of rotation of the wheels and wherein the support is connected to the beam at a location also below the axis of rotation.

8. A seating unit comprising:

a seat and a back;

a control supporting the seat and the back and operably supporting at least the back for reclining movement;

a wheelchair base including a pair of manually-operable wheels and including a frame located between the wheels; and a vertically-adjustable support engaging the control and supporting the seat and the back on the frame, wherein the frame includes opposing side subframes connected by the beam, the beam extending laterally therebetween.

9. A seating unit comprising:

a seat and a back;

a control supporting the seat and the back and operably supporting at least the back for reclining movement;

a wheelchair base including a pair of manually-operable wheels and including a frame located between the wheels; and a vertically-adjustable support engaging the control and supporting the seat and the back on the frame, wherein the seating assembly includes a seat, wherein the wheelchair base includes a pair of manually-operable wheels, and wherein a side of the seat and an inside of the wheels defines a space of at least a couple inches.

10. The seating unit defined in claim 9, wherein the seat is rotatably supported for movement to different angular positions relative to the base.

11. The seating unit defined in claim 9, wherein the adjustable support is connected to the beam at a location that is adapted to be near a center of gravity of the seating assembly when a user is seated therein.

12. The seating unit defined in claim 9, including armrests supported by one of the seat, the back, and the support.

13. A seating unit comprising:

a seat and a back;

a control supporting the seat and the back and operably supporting at least the back for reclining movement;

a wheelchair base including a pair of manually-operable wheels and including a frame located between the wheels; and a vertically-adjustable support engaging the control and supporting the seat and the back on the frame, wherein the wheelchair base includes rear wheels, and wherein the frame includes a beam located below an axis of rotation of the wheels and wherein the support is connected to the beam at a location also below the axis of rotation.

14. A seating unit comprising:

a seating assembly including a seating component and a control operably supporting the seating component for reclining movement;

a wheelchair base including manually-rotatable rear wheels defining an axis of rotation and a frame member defining a centered support location that is below and forward of the axis of rotation; and a vertical member engaging the control and supporting the seating unit on the frame member at the support location between the rear wheels.

* * * * *